US008313176B2

(12) United States Patent
Hayashi et al.

(10) Patent No.: US 8,313,176 B2
(45) Date of Patent: Nov. 20, 2012

(54) LIQUID EJECTION HEAD

(75) Inventors: Hideki Hayashi, Nagoya (JP); Tatsuo Terakura, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 154 days.

(21) Appl. No.: 12/892,340

(22) Filed: Sep. 28, 2010

(65) Prior Publication Data

US 2011/0102493 A1 May 5, 2011

(30) Foreign Application Priority Data

Oct. 29, 2009 (JP) ..... 2009-248408

(51) Int. Cl.
*B41J 2/045* (2006.01)
*B41J 2/015* (2006.01)

(52) U.S. Cl. ..... 347/71; 347/20
(58) Field of Classification Search ..... None
See application file for complete search history.

(56) References Cited

U.S. PATENT DOCUMENTS 7,500,736 B2 * 3/2009 Chikamoto ..... 347/71
2005/0036012 A1 2/2005 Terakura

FOREIGN PATENT DOCUMENTS

JP 2005-59410 3/2005

* cited by examiner

*Primary Examiner* — Geoffrey Mruk
(74) *Attorney, Agent, or Firm* — Scully, Scott, Murphy & Presser, PC

(57) ABSTRACT

A liquid ejection head may include a plurality of plates which are laminated via an adhesive. At least one of the plurality of plates may include a plurality of holes which are configured to function as liquid channels. The plate may include a plurality of individual bonding margins which are formed on a surface of the plate, and individually surround the plurality of holes. The plate may include a bonding margin bridge which extends parallel to a direction connecting the plurality of holes to each other, and connect the plurality of individual bonding margins to each other. The plate may include a groove which defines outer edges of the plurality of individual bonding margins and the bonding margin bridge on the surface of the plate.

8 Claims, 8 Drawing Sheets

66
191
192
226m
226a 66
226n
226d
266a
193
256a
66

266b
194
266b
66
226b
226o 226p
226e
266c
256b
66

266m
226c
256c
266d
66
226q
256c
286a
66
66
266d 226r
226f
266e
266f
66
256d
66

256e
266n
66
66
266g
226s
66
286b
226g
256e 66
66
66
266h
226t
266h
256f
226h
286c
266o
256f 66
66
66
226u
266i
226i
266i
256g
266p
286d
256g

LIQUID EJECTION HEAD

CROSS REFERENCE TO RELATED APPLICATION

This application claims priority to Japanese Patent Application No 2009-248408, filed Oct. 29, 2009, the entire subject matter and disclosure of which is incorporated herein by reference.

BACKGROUND OF THE DISCLOSURE

1. Field of the Disclosure

The features described herein relate generally to a liquid ejection head including a laminated body in which a plurality of plates are laminated onto each other via an adhesive.

2. Description of Related Art

A known liquid ejection head is formed by laminating a plurality of plates each having holes functioning as liquid channels onto each other via an adhesive. At this time, escape grooves for the adhesive may be formed around the holes functioning as liquid channels, thereby preventing excess adhesive from flowing into the holes.

When foreign matter is caught in between the plurality of plates, bonding failure may be occurred. More specifically, if foreign matter is caught in the vicinity of the holes where bonding margins are formed to individually surround the holes, the adhesive on the bonding margins alone may not provide sufficient bonding of the plurality of plates.

SUMMARY OF THE DISCLOSURE

According to one or more aspects described herein, a liquid ejection head may comprise a plurality of plates which are laminated via an adhesive. At least one of the plurality of plates may comprise a plurality of holes which are configured to function as liquid channels. The plate may comprise a plurality of individual bonding margins which are formed on a surface of the plate, and individually surround the plurality of holes. The plate may comprise a bonding margin bridge which extends parallel to a direction connecting the plurality of holes to each other, and connect the plurality of individual bonding margins to each other. The plate may comprise a groove which defines outer edges of the plurality of individual bonding margins and the bonding margin bridge on the surface of the plate.

Other objects, features and advantages will be apparent to persons of ordinary skill in the art from the following description with reference to the accompanying drawings.

DETAILED DESCRIPTION

Various aspects, features and advantages, may be understood by referring to FIGS. 1-8, like numerals being used for corresponding parts in the various drawings.

Figure 1:
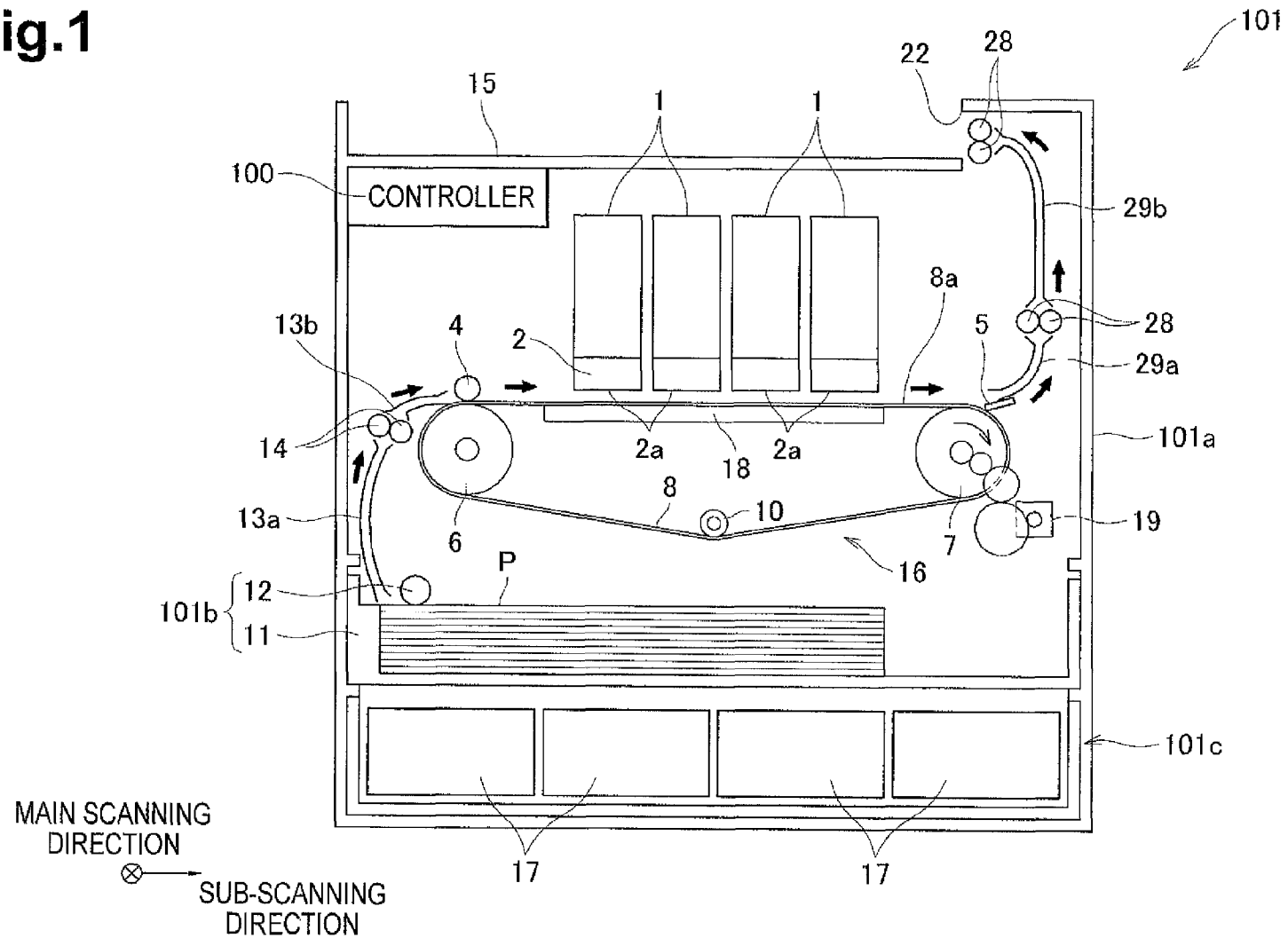
FIG. 1 is a schematic view showing the internal structure of an inkjet printer according to one or more aspects described herein.

Referring to FIG. 1, inkjet heads 1 (hereinafter, referred to as head 1) may be each a line head that is elongated along one direction (i.e., direction orthogonal to the plane of FIG. 1). The heads 1 may be disposed in an inkjet printer 101 (hereinafter, referred to as printer 101) with their longitudinal direction as the main scanning direction.

The printer 101 may include a housing 101*a* in a substantially rectangular parallelepiped shape. A paper delivery portion 15 is disposed on the top plate of the housing 101*a*. The internal space of the housing 101*a* may be divided into three spaces from the top.

In the top space out of the three spaces, a plurality of, e.g., four, heads 1 may be arranged in parallel at a predetermined spacing along the sub-scanning direction. Each of the heads 1 may be supported in place in a predetermined position of the housing 101*a* by a head frame (not shown). The plurality of, e.g., four, respective heads 1 may eject ink in magenta, cyan, yellow, and black. In this space, a conveyance mechanism 16 for conveying paper P while keeping the paper P opposed to the heads 1, and a controller 100 that controls the operations of individual units of the printer 101 may be disposed.

In the middle space, a paper feeding unit 101*b* may be disposed. The paper feeding unit 101*b* may be attached to and detached from the housing 101*a* in the main scanning direction. The paper feeding unit 101*b* may form a paper conveyance path extending along the thick arrows in FIG. 1, together with the conveyance mechanism 16.

In the bottom space, an ink tank unit 101*c* may be disposed. The ink tank unit 101*c* may be attached and detached in the main scanning direction. The ink tank unit 101*c* may have a plurality of, e.g., four, ink tanks 17 arranged in parallel in the sub-scanning direction. The respective ink tanks 17 may store ink of different colors in accordance with the corresponding heads 1. The ink tanks 17 may be each attached to and detached from the ink tank unit 101*c* in the main scanning direction.

Here, it is assumed that the sub-scanning direction is a direction parallel to the conveyance direction of the paper P by the conveyance mechanism 16. It is assumed that the main scanning direction is a direction orthogonal to the sub-scanning direction and along the horizontal plane.

The paper feeding unit 101*b* may include a box-shaped paper feed tray 11 for accommodating a plurality of sheets of paper P, and a paper feed roller 12 attached to the paper feed tray 11. The paper feed roller 12 may be rotated by drive of a paper feed motor (not shown), and may send out the uppermost sheet of paper P on the paper feed tray 11. The paper P thus sent out may be sent to the conveyance mechanism 16 by send rollers 14 while being guided by guides 13*a* and 13*b*.

The conveyance mechanism 16 may include a tension roller 10 in addition to a plurality of, e.g., two, belt rollers 6 and 7, and an endless conveyance belt 8 suspended between the belt rollers 6 and 7. The belt roller 7 may be a drive roller, which is driven by a conveyance motor 19 so as to rotate clockwise in the drawing under control by the controller 100. The belt roller 6 may be a driven roller, which similarly rotates clockwise as the conveyance belt 8 is run. The tension roller 10 may urge the inner peripheral surface in the lower loop of the conveyance belt 8, thereby imparting tension to the conveyance belt 8. The drive force of the conveyance motor 19 may be transmitted to the belt roller 7 via a plurality of gears.

Inside the loop of the conveyance belt 8, a platen 18 having a substantially rectangular parallelepiped shape may be disposed in opposition to the plurality of, e.g., four, heads 1. The upper loop of the conveyance belt 8 may be supported by the platen 18 from the inner peripheral surface side. The outer peripheral surface 8*a* of the conveyance belt 8 may be opposed in parallel to the ink ejection region (i.e., ejection surface 2*a* described later) of each of the plurality of, e.g., four, heads 1 at a spacing suitable for image formation.

A silicon layer with weak adhesiveness may be formed on the outer peripheral surface 8*a* of the conveyance belt 8. The paper P sent out from the paper feeding unit 101*b* may be pressed against the outer peripheral surface 8*a* by a nip roller 4 and then held by the outer peripheral surface 8*a* due to the adhesiveness, before being conveyed in the sub-scanning direction along the thick arrows.

As the paper P passes directly below the plurality of, e.g., four, heads 1, under control by the controller 100, ink droplets in respective colors may be sequentially ejected toward the upper surface of the paper P from the ink ejection regions of the respective heads 1, forming a desired color image on the paper P.

A separation plate 5 may be disposed at a position opposed to the belt roller 7. The paper P may be separated from the outer peripheral surface 8*a* by the separation plate 5 as it is conveyed. Thereafter, the paper P may be conveyed upwards by guides 29*a* and 29*b* and a plurality of, e.g., two, send roller pairs 28, and may be discharged to the paper delivery portion 15 from a discharge port 22 at the top of the housing 101*a*. One of each send roller pair 28 may be rotated by drive of a send motor (not shown) under control by the controller 100.

Figure 2:
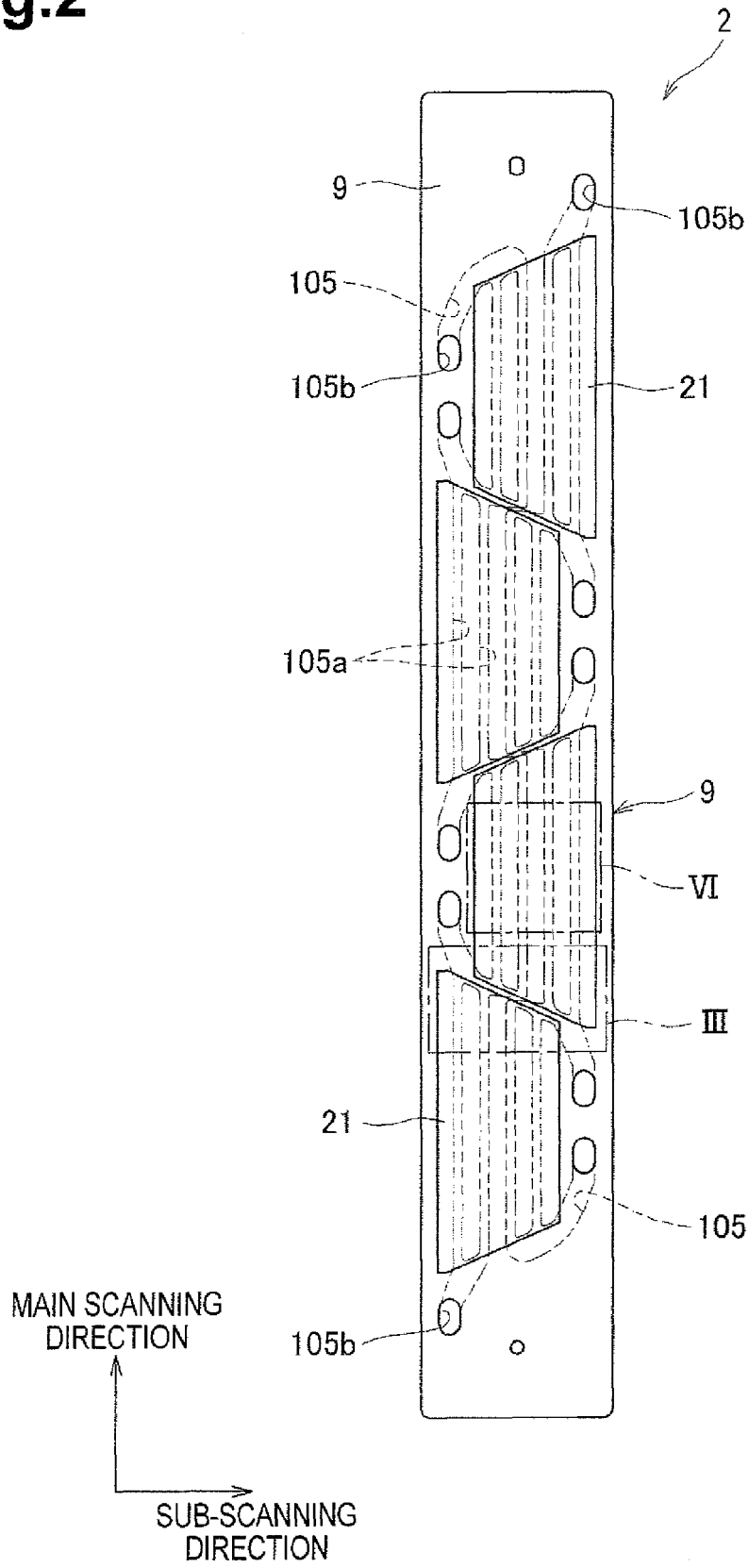
FIG. 2 is a plan view of a head body shown in FIG. 1.

Referring to FIG. 2, the head body 2 may include a channel unit 9, and a plurality of, e.g., four, actuator units 21 bonded onto the upper surface of the channel unit 9. Each of the actuator units 21 may have a trapezoidal outer shape. Ink channels may be formed in the interior of the channel unit 9, and the actuator units 21 may impart ejection energy to the ink in the channel unit 9.

A plurality of pressure chambers 110 and a plurality of, e.g., ten, ink support ports 105*b* may be formed in the upper surface of the channel unit 9. The pressure chambers 110 may form a plurality of, e.g., four, pressure chamber groups corresponding to the respective actuator units 21. The pressure chamber groups may be aligned in a plurality of, e.g., two, staggered rows in the main scanning direction, and may be sandwiched by the ink supply ports 105*b* from both sides at ends in the sub-scanning direction of the channel unit 9, along the main scanning direction. The pressure channel groups each may occupy a trapezoidal region in the upper surface of the channel unit 9. A plurality of pressure chambers 110 may be arranged in matrix within this region, forming 16 pressure chamber rows. The pressure chamber rows may extend in the main scanning direction, and may be arranged in parallel at equal spacings in the sub-scanning direction.

As indicated by broken lines in FIG. 2, a manifold channel 105 communicating with the ink supply ports 105*b*, and sub-manifold channels 105*a* branching from the manifold channel 105 may be formed inside the fluid channel 9. The manifold channel 105 may extend along the oblique sides of the actuator units 21 in plan view. In a region corresponding to each of the actuator units 21, a plurality of, e.g., four, sub-manifold channels may extend in the main scanning direction. Each sub-manifold channel may fluidly communicate with the manifold channel 105 at its both ends. The pressure chambers 110 may communicate with the sub-manifold channels 105*a* at their one end side.

The same number of ejection ports 108 as that of the pressure chambers 110 may be formed in the lower surface (i.e., ejection surface 2*a*) of the channel unit 9. The respective ejection ports 108 may communicate with the pressure chambers 110 in the upper surface via channels that extend through the channel unit 9. The ejection ports 108 may form q plurality of, e.g., four, trapezoid-shaped ejection port groups corresponding to the respective actuator units 21. Within the region occupied by each ejection port group, a plurality of ejection ports 108 may be arranged in matrix, forming 16 ejection port rows like the pressure chambers 110. The ejection port rows may extend along the main scanning direction while avoiding the sub-manifold channels 105*a* in plan view.

Figure 4:
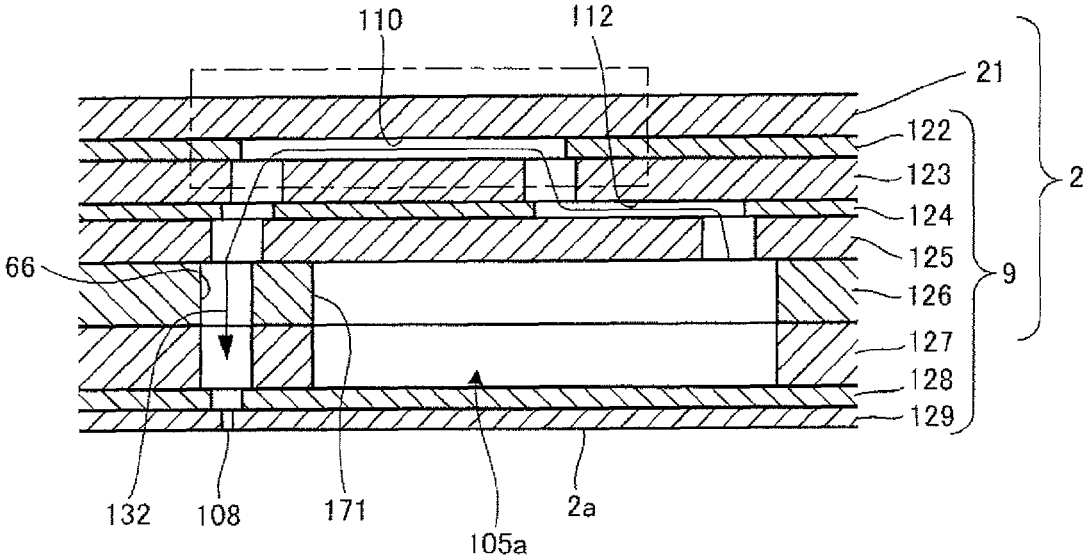
FIG. 4 is a partial sectional view of a channel unit taken along the line IV-IV shown in FIG. 3.

Referring to FIG. 4, the channel unit 9 may include a plurality of, e.g., nine, metallic plates 122 to 129 made from stainless steel. Channel holes forming ink channels may be formed in these plates. The channel unit 9 may be a laminated body obtained by bringing the plates 122 to 129 into alignment with each other and then laminating the plates 122 to 129 via an adhesive. Thus, the manifold channel 105 communicating with the ink supply ports 105*b*, the sub-manifold channels 105*a* branching from the manifold channel 105, and a plurality of individual ink channels 132 that extend from the outlets of the sub-manifold channels 105*a* and reach the ejection ports 108 via the pressure chambers 110 may be formed.

Figure 6:
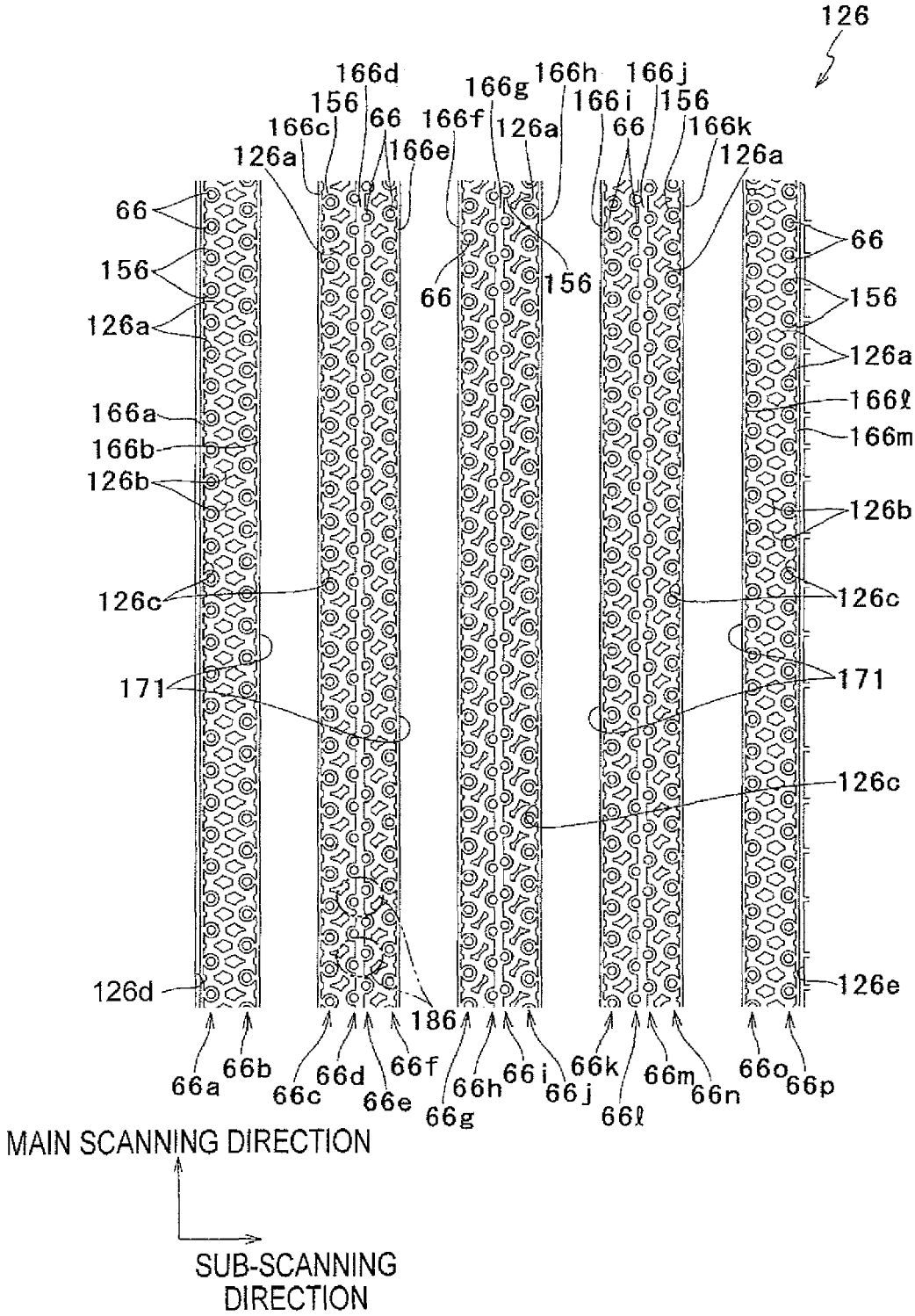
FIG. 6 is an enlarged plan view of a region of a plate forming the channel unit which is indicated by alternate long and short dashed lines VI in FIG. 2.

Referring to FIG. 6, channels holes 66 and channel holes 171 may be formed in the plate 126. The channel holes 66 and the channel holes 171 may be through-holes that extend through the plate 126 in the thickness direction. The channel holes 66 may form part of channels connecting between the pressure chambers 110 and the ejection ports 108. The channel holes 171 may form the upper half of the sub-manifold channels 105*a*.

Figure 3:
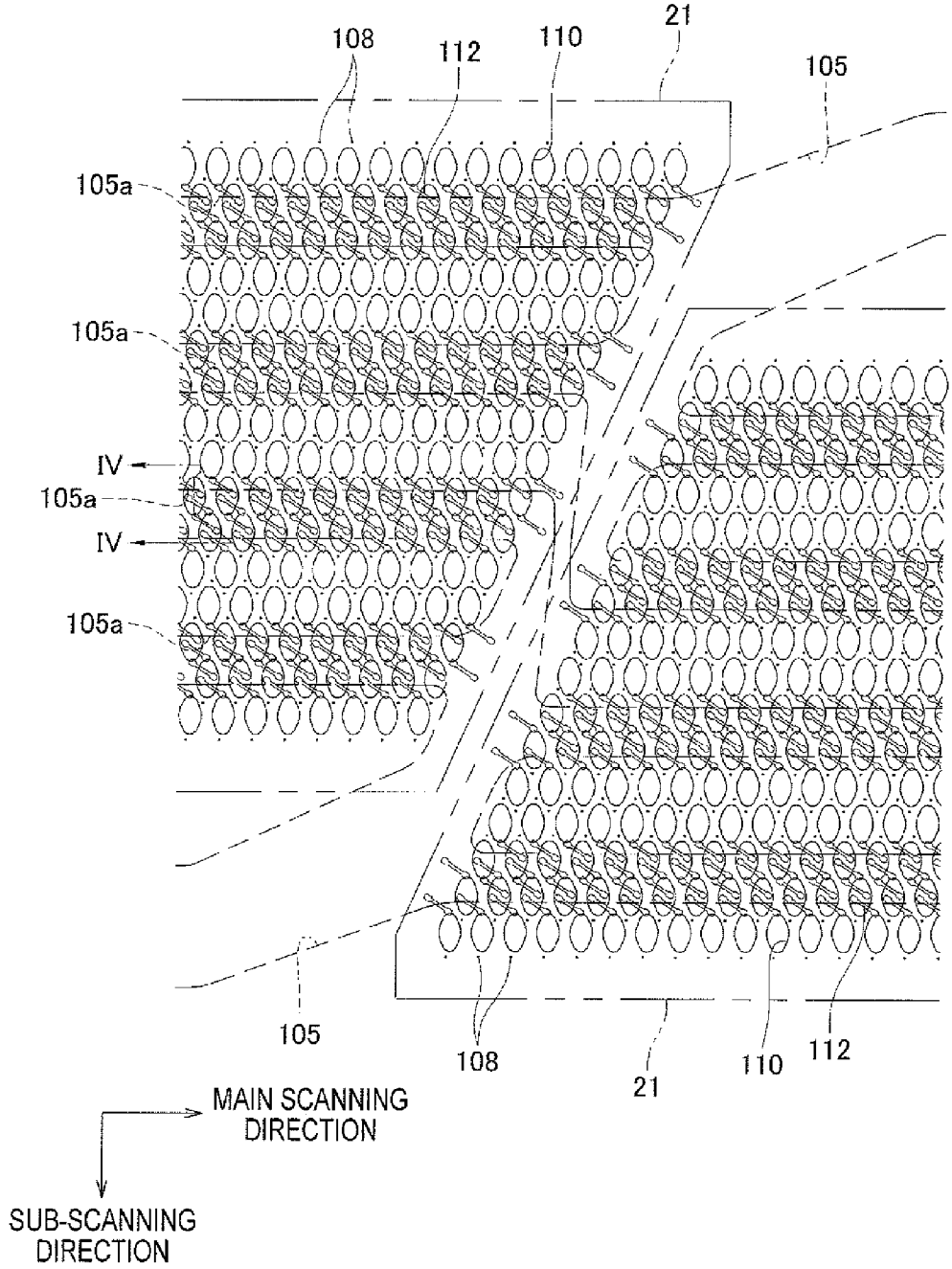
FIG. 3 is an enlarged plan view of a region of the head body shown in FIG. 2 which is bounded by alternate long and short dashed lines III.

Referring to FIGS. 2 to 4, ink supplied into the channel unit 9 via the ink supply ports 105*b* may be distributed to the sub-manifold channels 105*a* from the manifold channel 105. Further, the ink may flow into the individual ink channels 132, and may reach the ejection ports via the apertures 112 each functioning as a restrictor and the pressure chambers 110.

Referring back to FIG. 2, the plurality of, e.g., four, actuator units 21 may be arranged in plurality of, e.g., two, staggered rows so as to avoid the ink supply ports 105*b*. The opposite parallel sides of each actuator unit 21 may extend along the longitudinal direction of the channel unit 9. The oblique sides of adjacent actuator units 21 may overlap each other with respect to the width direction (i.e., sub-scanning direction) of the flow channel 9.

Figure 5A:
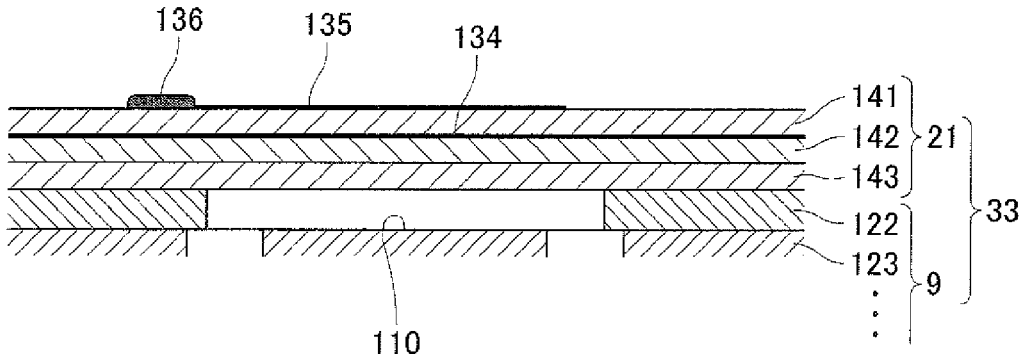
FIGS. 5A and 5B are respectively an enlarged sectional view of a region indicated by alternate long and short dashed lines in FIG. 4, and a plan view of an individual electrode.

Referring fo FIG. 5A, each actuator unit 21 may be formed by a plurality of, e.g., three, piezoelectric sheets 141 to 143 including a plumbum-zirconate titanate (PZT)-based ceramic material having ferroelectricity. Each of the piezoelectric sheets 141 to 143 may include a single sheet having such a shape and size that the sheet extends over a plurality of pressure chambers 110 (i.e., pressure chamber group). The piezoelectric sheet 141 in the uppermost layer may be polarized in the thickness direction. An individual electrode 135 may be disposed on the upper surface of the piezoelectric sheet 141 opposing each pressure chamber 110. Between the piezoelectric sheet 141 and the piezoelectric sheet 142, a common electrode 134 may be formed across the entire sheet surface. The piezoelectric sheet 143 in the lowermost layer may be not polarized and may function as a diaphragm like the piezoelectric sheet 142. The lower surface of the piezoelectric sheet 143 may be bonded to the channel unit 9.

Figure 5B:
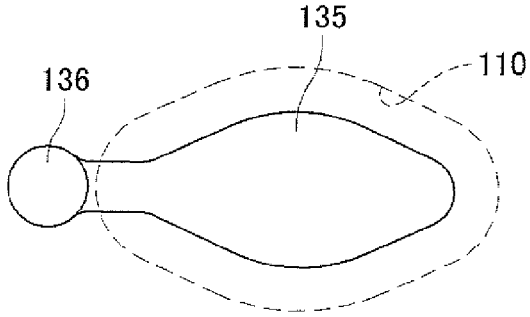

Referring to FIG. 5B, the individual electrode 135 may have a substantially rhombic shape similar to that of each pressure chamber 110. The individual electrode 135 may include a main electrode portion within a region opposing the pressure chamber 110, a sub-electrode portion led out from the acute-angled portion of the main electrode portion, and an individual bump 136 located outside the opposing region and formed on the sub-electrode portion. A common bump for the common electrode may be formed on the piezoelectric sheet 141. The common bump may be connected to the common electrode via a through-hole (not shown).

Each of the bumps may be connected to an Flexible Printed Circuit (i.e., FPC) board with a driver IC mounted thereon. A drive signal may be selectively supplied to the individual bump 136, and a reference potential (i.e., ground potential) is supplied to the common bump.

When a drive signal is supplied to the individual bump 136, the portion of the piezoelectric sheet 141 opposing the individual electrode 135 may be distorted due to the piezoelectric effect. On the other hand, the plurality of, e.g., two, piezoelectric sheets 141 and 143 may not undergo spontaneous distortion. The difference in distortion in the plane direction occurring at this time may cause the portion opposing the individual electrode 135 to undergo deformation (i.e., unimorph deformation) so as to protrude toward each pressure chamber 110. In accordance with the deformation toward the pressure chamber 110, ink within the pressure chamber 110 may be ejected from each of the ejection ports 108.

Referring to FIG. 6, the upper surface of the plate 126 which functions as a joining surface with the plate 125 may be a surface to which an adhesive is applied. As described above, the channel holes 66 and the channel holes 171 may be formed in the upper surface of the plate 126. The plurality of, e.g., four channel holes 171 may be formed within this region along the main scanning direction. The channel holes 66 may be arrayed at positions along the main scanning direction so as to avoid the channel holes 171. Thus, 16 channel hole rows 66*a* to 66*p* that are parallel to each other may be formed. In each of the channel hole rows 66*a* to 66*p*, the channel holes 66 may be arrayed at equal spacings in the main scanning direction. With respect to the main scanning direction, any two channel holes 66 belonging to different channel hole rows may be formed at different positions, in such a way that the channel holes 66 are arranged at equal spacings corresponding to 600 dpi (i.e., dot per inch) as a whole.

Individual bonding margins 156 individually surrounding the channel holes 66, and escape grooves 126*a* for adhesive may be formed around the channel holes 66 adjacent to the channel holes 171 and the channel holes 66 forming the channel hole rows 66*a* and 66*p*. The outer edges of the individual bonding margins 156 may be defined by the escape grooves 126, and may be formed in the same annular shape as that of the channel holes 66. Thus, in the direction toward the center of each channel hole 66, the distance from the outer edge of each individual bonding margin 156 to its inner edge, that is, to the outer edge of each channel hole 66, may be the same at any location. That is, the width of the individual bonding margin 156 may be uniform, and the same may apply to any individual bonding margin 156. Thus, when an adhesive is applied to the plate 126, the adhesive may be uniformly distributed around the channel holes 66.

The escape grooves 126*a* may extend along the respective outer edges of the individual bonding margins 156. With respect to the main scanning direction, the escape grooves 126*a* may be connected to each other by linear escape grooves 126*c* extending along the main scanning direction. With respect to the sub-scanning direction, the escape grooves 126*a* may be joined to each other by linear escape grooves 126*b*. The escape grooves 126*b* may extend so as to cross both the main scanning direction and the sub-scanning direction. These escape grooves may communicate with the outside of the channel unit 9 via communication holes (not shown). That is, the escape grooves may be exposed to the atmosphere, allowing for easy escape of excess adhesive.

The distance between the channel holes 66 belonging to the channel hole row 66*d* and the channel holes 66 belonging to the channel hole row 66*e* may be less than twice the width of the individual bonding margins 156 at the location where the two channel holes 66 are at their closest. Therefore, the individual bonding margins 156 may be partially overlapped and coupled with each other, forming coupled bonding margins 186 each containing two channel holes 66. Further, a plurality of coupled bonding margins 186 are arranged at equal spacings along the main scanning direction. The same may apply to the set of the channel hole row 66*h* and the channel hole row 66*i*, and the set of the channel hole row 66*l* and the channel hole row 66*m*.

The individual bonding margins 156 may be connected to each other by bonding margin bridges 166*a* to 166*m* with respect to the main scanning direction. The bonding margin bridges 166*a* to 166*m* may be each a bonding margin that extends linearly along the main scanning direction. Of these, the bonding margin bridges 166*a*, 166*c*, 166*f*, 166*i*, and 166*l* may be formed continuously along the main scanning direction, and may connect the individual bonding margins 156 corresponding to the channel hole rows 66*a*, 66*c*, 66*g*, 66*k*, and 66*o* in the vicinity of the corresponding left ends in FIG. 6, respectively. The bonding margin bridges 166*b*, 166*e*, 166*h*, 166*k*, and 166*m* may be formed continuously along the main scanning direction, and may connect the individual bonding margins 156 corresponding to the channel hole rows 66*b*, 66*f*, 66*j*, 66*n*, and 66*p* in the vicinity of the corresponding right ends in FIG. 6, respectively.

The bonding margin bridge 166*d* may be connected to the central portion of each coupled bonding margin 186 with respect to the sub-scanning direction, and may connect the coupled bonding margins 186 to each other in the main scanning direction. More specifically, the bonding margin bridge 166*d* may connect the individual bonding margins 156 corresponding to the channel hole row 66*d* in the vicinity of the right end in FIG. 6, and may connect the individual bonding margins 156 corresponding to the channel hole row 66*e* in the vicinity of the left end in FIG. 6. Therefore, the bonding margin bridge 166*d* may integrally connect sets of individual bonding margins 156 surrounding the channel holes 66 to each other in the main scanning direction, with respect to each of the channel hole row 66*d* and the channel hole row 66*e*. The bonding margin bridge 166*g* and the bonding margin bridge 166*i* may have the same configuration as that of the bonding margin bridge 166*d*.

Outside the bonding margin bridge 166*a*, escape grooves 126*d* may be formed along the left end edge of the bonding margin bridge 166*a* in FIG. 6. Outside the bonding margin bridge 166*m*, escape grooves 126*e* may be formed along the right end edge of the bonding margin bridge 166*m* in FIG. 6.

The channel holes 66 and 171 may be formed as through-holes by etching in a flat plate that functions as the plate 126. Also, the escape grooves 126*a* to 126*e* may be formed as recesses by half etching in the flat plate that functions as the plate 126. The individual bonding margins 156, and the bonding margin bridges 166*a* to 166*m* may be portions that are left between the etched or half-etched regions of the flat plate that functions as the plate 126.

As described above, every one of the individual bonding margins 156 formed in the plate 126 may be connected to another individual bonding margin 156 via one of the bonding margin bridges 166*a* to 166*m*. According to this structure, when joining the plate 126 to the plate 125 via an adhesive, an adhesive may be supplied to each individual bonding margin 156 where bonding failure may occur, from one of the bonding margin bridges 166*a* to 166*m* joined to the above individual bonding margin 156, or from the individual bonding margin 156 adjacent to the above individual bonding margin 156. For example, if foreign matter is caught in between the plate 125 and the plate 126, in the individual bonding margin 156 positioned in the vicinity, adhesive may be not enough for joining the plate 126 to the plate 125. However, since adhesive is supplied from the surroundings as described above, such bonding failure may become less liable to occur.

If the area of each of the bonding margin bridges 166*a* to 166*m* is larger than each individual bonding margin 156 or coupled bonding margin 186, the area of each escape groove 126*a* or the like may become conversely small, making it difficult for the escape groove to capture excess adhesive. In this case, overflowing adhesive may flow into the channel holes 66, which may affect ink ejection characteristics. It may become more likely for foreign matter to be caught in the bonding margin bridges 166*a* to 166*m* than in the individual bonding margins 156. Therefore, in order to secure the area for the escape groove and reduce the risk of catching foreign matter, the area of each of the bonding margin bridges 166*a* to 166*m* may be smaller than the area of each individual bonding margin 156 or coupled bonding margin 186.

On the other hand, if the area of each of the bonding margin bridges 166*a* to 166*m* is too small relative to the area of each individual bonding margin 156 or coupled bonding margin 186, enough adhesive may not be supplied to the nearby individual bonding margins 156 when foreign matter is caught. Accordingly, an area equal to at least about 20% of the area of each individual bonding margin 156 or coupled bonding margin 186 may be secured as the area of each of the bonding margin bridges 166*a* to 166*m*.

Figure 7A:
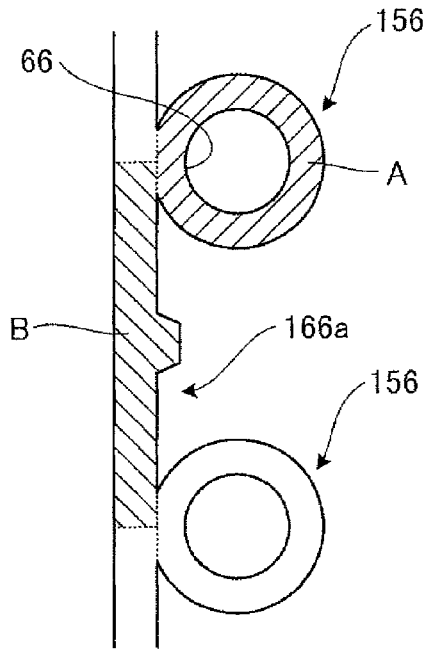
FIGS. 7A and 7B are respectively an enlarged view of the vicinity of a bonding margin bridge connected to the ends of individual bonding margins shown in FIG. 6, and an enlarged view of the vicinity of a coupled bonding margin bridge shown in FIG. 6.

Referring to FIG. 7A, as an example, letting Sa be the area of a region A corresponding to each single individual bonding margin 156, and Sb be the area of a region B connecting between the individual bonding margins 156 in the bonding margin bridge 166*a*, the bonding margin bridge 166*a* may be so formed as to satisfy $0.2 \leqq Sb/Sa \leqq 1.0$. If the bonding margin bridge 166*a* is formed so that $Sb/Sa \leqq 0.2$, enough adhesive may not be supplied, and hence bonding failure may not be avoided. Also, if the bonding margin bridge 166*a* is formed so that $1.0 < Sb/Sa$, excess adhesive may flow into the channel holes 66 without being captured by the escape grooves, or foreign matter may be liable to be caught in the bonding margin bridge 166*a* and thus bonding failure may become liable to occur.

Figure 7B:
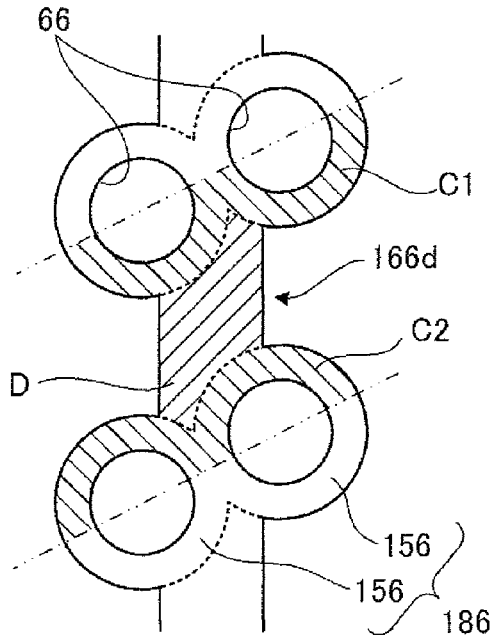

Referring to FIG. 7B, letting Sc be the area of a region C (i.e., the region combining two regions indicated as C1 and C2 in the drawing) occupied by each coupled bonding margin 186, and Sd be the area of a region D connecting between the coupled bonding margins 186 in the bonding margin bridge 166*d*, the bonding margin bridge 166*d* may be so formed as to satisfy $0.2 \leqq Sd/Sc \leqq 1.0$. Half the area of each coupled bonding margin 186 may be substantially equal to the area of each single individual bonding margin 156.

Figures 8A, 8B, 8C, 8D, 8E, 8F, 8G, 8H, 8I:
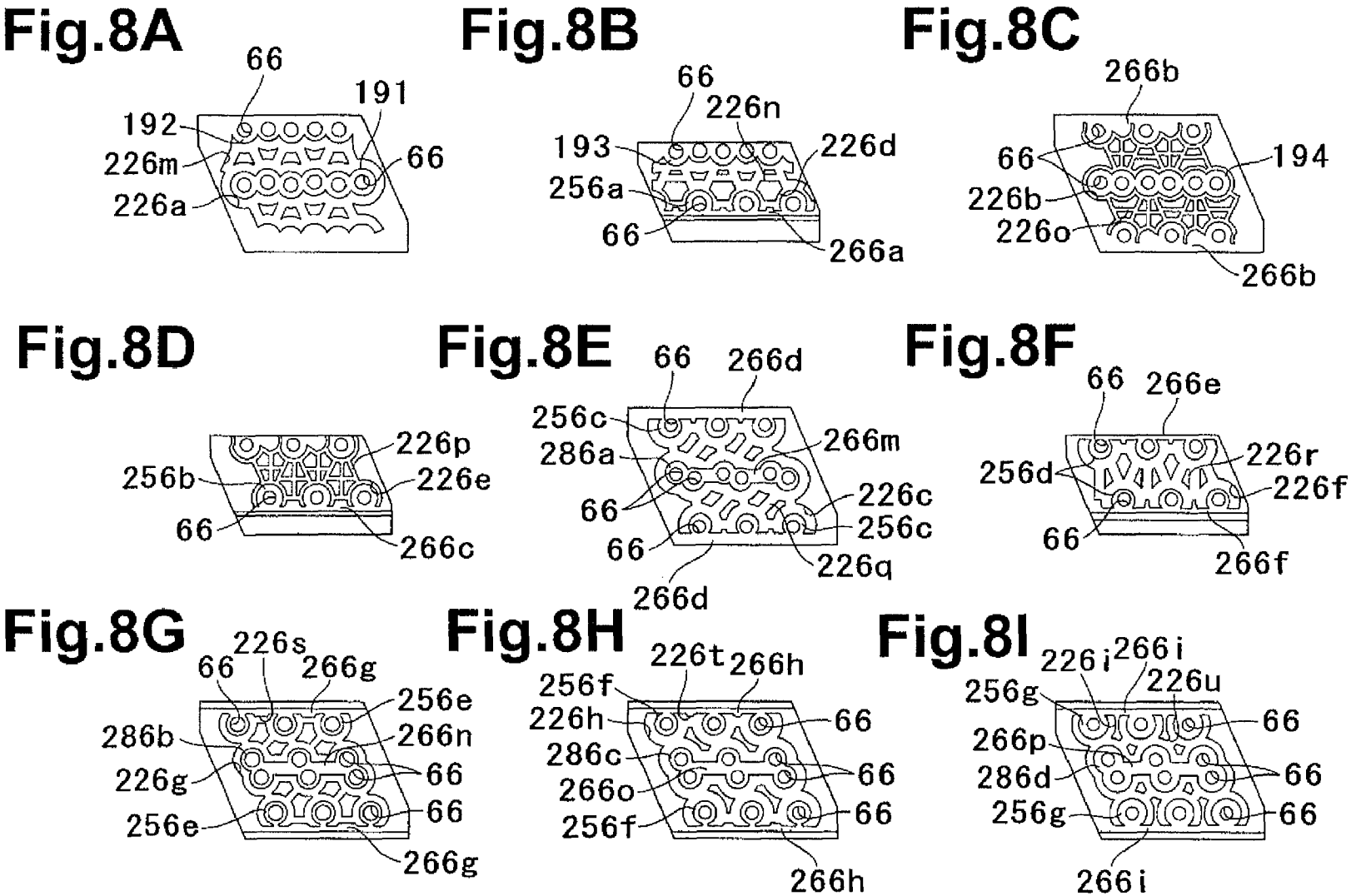
FIGS. 8A to 8I are views showing the structures of bonding margins and escape grooves which are applied to plates other than that shown in FIG. 6.

FIGS. 8A to 8I shows the structures of bonding margins and escape grooves applicable to the plates 121 to 125 and 127 to 129 that are plates forming the channel unit 9 other than the plate 126. In each of FIGS. 8A to 8I, the left-right direction is the direction parallel to the main scanning direction. Also, each of these drawings shows only some of bonding margins and escape grooves. When these illustrated structures are actually applied to the plates 121 to 125 and 127 to 129, each of such structures may be arrayed repetitively with respect to the main scanning direction. FIGS. 8A, 8C, 8E, 8G, 8H, and 8I are each applied to, for example, a region sandwiched between the channel holes 171 in plan view, like the region where the channel hole rows 66*c* to 66*f* are formed in FIG. 6. FIGS. 8B, 8D, and 8F are each applied to, for example, a region at an end of a plate with respect to the sub-scanning direction, like the region where the channel hole rows 66*a* and 66*b* are formed in FIG. 6.

As described above, a plurality of channel holes 66 forming part of the individual ink channels 132 may be arrayed at equal spacings with respect to the main scanning direction, and bonding margins such as individual bonding margins 256*a* to 256*g* and coupled bonding margins 286*a* to 286*d* may be formed around the channel holes 66. While many of these bonding margins are formed in an annular shape concentric with the channel holes 66, bonding margins may be formed in an annular shape whose center is offset from the center of the channel holes 66. Also, these bonding margins may vary in their width from the inner edge to the outer edge. Bonding margins may be formed as continuously coupled bonding margins 191 to 194, in which the channel holes 66 are all positioned close to each other and the individual bonding margins are all directly connected to each other without any bonding margin bridge therebetween.

Escape grooves 226*a* to 226*i* that define the outer edges of the bonding margins may be formed around the bonding margins. The bonding margins may include the individual bonding margins 256*a* to 256*g* and the coupled bonding margins 286*a* to 286*d*. While the escape grooves 226*a* to 226*i* are formed in an annular shape concentric with the channel holes 66, the escape grooves may be formed in an annular shape whose center is offset from the center of the channel holes 66. Also, these escape grooves may vary in their width from the inner edge to the outer edge. Each two escape grooves 226*a*, each two escape grooves 226*b*, and the like may be connected together by escape grooves 226*m* to 226*u*. Each of the escape grooves 226*m* to 226*u* may include a plurality of escape grooves formed in a linear shape. Like the escape grooves 226*n* and 226*o*, a plurality of linear escape grooves may cross each other to from a mesh-like structure.

Each two individual bonding margins 256*a* to 256*g* may be connected together by bonding margin bridges 266*a* to 266*i* that are formed linearly along the main scanning direction. The bonding margin bridges 266*a* to 266*i* may connect to one ends with respect to the sub-scanning direction of the individual bonding margins 256*a* to 256*g*. The positional relationship between each of the bonding margin bridges 266*a* to 266*i* and each channel hole 66 may vary. For example, there may be bonding margin bridges like the bonding margin bridge 266*a* which are positioned very close to the channel holes 66 with respect to the sub-scanning direction, or bonding margin bridges like the bonding margin bridge 266*h* which are spaced apart from the channel holes 66 with respect to the sub-scanning direction and barely connect to the individual bonding margins 256*f*. Letting Sa be the area of a region corresponding to each single individual bonding margin, and Sb be the area of a region connecting between individual bonding margins in a bonding margin bridge, the bonding margin bridge may be formed so as to satisfy $0.2 \leqq Sb/Sa \leqq 1.0$.

Each of the coupled bonding margins 286*a* to 286*d* may be a bonding margin formed by coupling of two individual bonding margins. As for the manner of coupling, like the coupled bonding margins 286*a*, the individual bonding margins may be coupled together by the channel holes 66 being positioned close to each other with respect to the main scanning direction, or like the coupled bonding margins 286*b*, the individual bonding margins may be coupled together by the channel holes 66 being positioned close to each other with respect to the sub-scanning direction. Each two coupled bonding margins 286*a* to 286*d* may be coupled together by the bonding margin bridges 266*m* to 266*p* that are formed linearly along the main scanning direction. The bonding margin bridges 266*m* and 266*p* may be connected to the central portions of the coupled bonding margins 286*a* to 286*d* with respect to the sub-scanning direction. Letting Sc be the area of a coupled bonding margin, and Sd be the area of a region connecting between coupled bonding margins in a bonding margin bridge, the bonding margin bridge may be formed so as to satisfy $0.2 \leqq Sd/Sc \leqq 1.0$.

According to the embodiment described above, the bonding margin bridge 166*a* and the like connecting the individual bonding margins 156 and the like may be formed in the bonding surfaces of the plates forming the channel unit 9. Therefore, when foreign matter is caught in between the plates, an adhesive may be supplied to the individual bonding margins 156 and the like from the bonding margin bridge 166*a* and the like, making bonding failure less likely to occur.

Each individual bonding margin 156 and the bonding margin bridge 166*a* may be formed in such a way that the area Sa of the individual bonding margin 156 and the area Sb of the bonding margin bridge 166*a* satisfy $0.2 \leqq Sb/Sa \leqq 1.0$. The same may apply to other individual bonding margins and bonding margin bridges. Thus, a balance may be struck so as to reduce catching of foreign matter while securing supply of an adhesive.

Since the bonding margin bridge 166*a* and the like are formed linearly, an adhesive may be smoothly supplied to the individual bonding margins 156 and the like, and also an increase in the area of each bonding margin, which causes catching of foreign matter, may be prevented.

In the embodiment described above, the coupled bonding margins 186 are each formed by coupling of two individual bonding margins 156. However, coupled bonding margins may be each formed by coupling of three or more individual bonding margins 156, and such coupled bonding margins may be connected to each other by a bonding margin bridge.

In the embodiment described above, an liquid ejection head is configured to eject ink from nozzles. However, the liquid ejection head may be configured to eject a conductive paste to form fine wiring patterns on a substrate. The liquid ejection head may be configured to eject organic emitters onto a substrate to form a high-definition display. The liquid ejection head may be configured to eject optical resin onto a substrate to form a minute electronic device such as an optical waveguide.

In the embodiment described above, a piezoelectric actuator is used. However, an electrostatic actuator or a resistive heating actuator may be used.

While the invention has been described in connection with various exemplary structures and illustrative embodiments, it will be understood by those skilled in the art that other variations and modifications of the structures and embodiments described above may be made without departing from the scope of the invention. Other structures and embodiments will be apparent to those skilled in the art from a consideration of the specification or practice of the invention disclosed herein. It is intended that the specification and the described examples are illustrative with the true scope of the invention being defined by the following claims.

What is claimed is:

1. A liquid ejection head comprising a plurality of plates which are laminated via an adhesive, at least one of the plurality of plates comprising:

a plurality of holes which are configured to function as liquid channels;

a plurality of individual bonding margins which are formed on a surface of the plate, and individually surround the plurality of holes;

a bonding margin bridge which extends parallel to a direction connecting the plurality of holes to each other, and connect the plurality of individual bonding margins to each other; and a groove which defines outer edges of the plurality of individual bonding margins and the bonding margin bridge on the surface of the plate, wherein the bonding margin bridge further comprise a first bonding margin bridge, and wherein an area Sa of one of the plurality of individual bonding margins and an area Sb of the first bonding margin bridge satisfy $Sb \leqq Sa$ and $0.2 \leqq Sb/Sa \leqq 1.0$ is satisfied.

2. The liquid ejection head according to claim 1, wherein the bonding margin bridge is formed in a linear shape parallel to the direction connecting the plurality of holes to each other.

3. The liquid ejection head according to claim 1, wherein any one of the plurality of individual bonding margins is connected to another one of the plurality of individual bonding margins via the bonding margin bridge.

4. The liquid ejection head according to claim 1, wherein the plurality of individual bonding margins comprise a plurality of coupled bonding margins, in which the plurality of individual bonding margins are partially overlapped and coupled with each other, and wherein the bonding margin bridge comprises a second bonding margin bridge which connects the plurality of coupled bonding margins to each other.

5. The liquid ejection head according to claim 4, wherein an area Sc of one of the plurality of coupled bonding margins and an area Sd of the second bonding margin bridge satisfy $0.2 \leqq Sd/Sc \leqq 1.0$.

6. The liquid ejection head according to claim 1, further comprising a plurality of bonding margin bridges;

wherein the plurality of holes are arranged along one direction;

wherein the plurality of bonding margin bridges each connecting the plurality of individual bonding margins to each other are arranged on an imaginary straight line parallel to the one direction; and wherein the plurality of individual bonding margins are connected to the bonding margin bridge formed in a linear shape to the direction connecting the plurality of holes to each other, in a vicinity of one end with respect to a direction orthogonal to the one direction.

7. The liquid ejection head according to claim 1, wherein an outer edge of each of the plurality of individual bonding margins lies along positions equidistant from an outer edge of each of the plurality of holes.

8. The liquid ejection head according to claim 1, wherein the groove is exposed to an atmosphere.

* * * * *